US008061326B2

(12) United States Patent
Karabatsos

(10) Patent No.: US 8,061,326 B2
(45) Date of Patent: Nov. 22, 2011

(54) FOUR CYCLE ENGINE WITH LOAD CRANK

(76) Inventor: Chris Karabatsos, Kingston, NY (US)

( * ) Notice: Subject to any disclaimer, the term of this patent is extended or adjusted under 35 U.S.C. 154(b) by 0 days.

(21) Appl. No.: 12/841,470

(22) Filed: Jul. 22, 2010

(65) Prior Publication Data

US 2011/0017167 A1 Jan. 27, 2011

Related U.S. Application Data

(60) Provisional application No. 61/271,648, filed on Jul. 24, 2009.

(51) Int. Cl.
*F02B 75/06* (2006.01)
*F02B 75/32* (2006.01)

(52) U.S. Cl. ..... 123/197.1; 123/192.1; 123/197.4

(58) Field of Classification Search ..... 123/192.1, 123/192.2, 197.1, 197.4
See application file for complete search history.

(56) References Cited

U.S. PATENT DOCUMENTS 1,522,326 A * 1/1925 Reineke ..... 123/197.1
* cited by examiner

*Primary Examiner* — Noah Kamen
(74) *Attorney, Agent, or Firm* — Mark P White

(57) ABSTRACT

A system for converting the energy created by the ignition of fuel in one or more cylinders of an internal combustion engine to rotational power, having a piston within each of its cylinders, includes one or more first connecting rods, each rotatingly affixed at a first end to the corresponding piston, a master crank to which each such first connecting rod is rotatingly attached at a second, a load crank and one or more second connecting rods, the number corresponding to the number of first connecting rods, each second connecting rod rotatingly affixed at one end to the master crank, and at the other end to the load crank. The second connecting rods may be of the same length as that of the first connecting rods, or of different length.

5 Claims, 21 Drawing Sheets

FOUR CYCLE ENGINE WITH LOAD CRANK

This application claims priority based on Provisional patent No. 61/271,648 (Jul. 24, 2009) for "Engine".

FIELD OF THE SYSTEM DESCRIBED HEREIN

The scope of this system described herein is to provide a solution to the construction of an engine which will provide a noticeable improvement in power generation with a given quantity of fuel power density. Types of fuel are not restricted to a single kind such as gasoline. Many devices that convert a form of rotational energy to another form of energy will benefit with the application of this system described herein.

DESCRIPTION RELATIVE TO THE PRIOR ART

For purposes of demonstration, the four cylinder internal fuel combustion engine will be used without restriction of applications to engines with more than four or less than four cylinders or no cylinders at all.

For better description of the prior art, copies of entries contained in the Wikipedia encyclopedia (http://en.wikipedia.org/wiki/Main_Page) are stated herein in quotations.

"An internal combustion engine is an engine in which the combustion of a fuel occurs in a combustion chamber inside and integral to the engine. In an internal combustion engine it is always the expansion of the high temperature and pressure gases that are produced by the combustion which apply force to the movable component of the engine, such as the pistons or turbine blades."

"The term internal combustion engine usually refers to an engine in which combustion is intermittent, such as the more familiar four-stroke and two-stroke piston engines, along with variants, such as the Wankel rotary engine. A second class of internal combustion engines use continuous combustion: jet engines (including gas turbines) and most rockets, each of which are internal combustion engines on the same principle as previously described."

"The internal combustion engine (or ICE) contrasts with the external combustion engine, such as a steam or Stirling engine in which the energy is delivered within a working fluid heated in a boiler by fossil fuel, wood-burning, nuclear, solar etc."

"A large number of different designs for ICEs have been developed and built, with a variety of different strengths and weaknesses. While there have been and still are many stationary applications, the real strength of internal combustion engines is in mobile applications and they completely dominate as a power supply for cars, aircraft, and boats, from the smallest to the biggest. Only for hand-held power tools do they share part of the market with battery powered devices. Powered by an energy-dense fuel (nearly always liquid, derived from fossil fuels) the ICE delivers an excellent power-to-weight ratio with very few safety or other disadvantages."

Applications

"Internal combustion engines are most commonly used for mobile propulsion in vehicles and portable machinery. In mobile equipment, internal combustion is advantageous since it can provide high power-to-weight ratios together with excellent fuel energy density. Generally using fossil fuel (mainly petroleum), these engines have appeared in transport in almost all vehicles (automobiles, trucks, motorcycles, boats, and in a wide variety of aircraft and locomotives)."

"Internal combustion engines appear in the form of gas turbines as well where a very high power is required, such as in jet aircraft, helicopters, and large ships. They are also frequently used for electric generators and by industry."

Power Output Limit

"The amount of power generated by a four-stroke engine is related to its speed. The speed is ultimately limited by material strength. Valves, pistons and connecting rods (where applicable) suffer severe acceleration forces. At high engine speed, physical breakage and piston ring flutter can occur, resulting in power loss or even engine destruction. Piston ring flutter occurs when the rings oscillate vertically within the piston grooves they reside in. Ring flutter compromises the seal between the ring and the cylinder wall which results in a loss of cylinder pressure and power. If an engine spins too quickly, valve springs cannot act quickly enough to close the valves. This is commonly referred to as 'valve float', and it can result in piston to valve contact, severely damaging the engine."

Intake/Exhaust Port Flow

"The output power of an engine is dependent on the ability of intake (air-fuel mixture) and exhaust matter to move quickly through valve ports, typically located in the cylinder head. To increase an engine's output power, irregularities in the intake and exhaust paths, such as casting flaws, can be removed, and, with the aid of an air flow bench, the radii of valve port turns and valve seat configuration can be modified to reduce resistance. This process is called porting, and it can be done by hand or with a CNC machine . . . ."

The Otto Cycle

"The four-stroke engine was first patented by Eugenio Barsanti and Felice Matteucci in 1854, followed by a first prototype in 1860. It was also conceptualized by French engineer, Alphonse Beau de Rochas in 1862. However, the German engineer Nicolaus Otto was the first to develop a functioning four-stroke engine, which is why the four-stroke principle today is commonly known as the Otto cycle and four-stroke engines using spark plugs often are called Otto engines."

"1879: Karl Benz, working independently, was granted a patent for his internal combustion engine, a reliable two-stroke gas engine, based on the same technology as Nikolaus Otto's design of the four-stroke engine. Later, Benz designed and built his own four-stroke engine that was used in his automobiles, which were developed in 1885, patented in 1886, and became the first automobiles in production."

Four-Stroke Cycle Operation

"Idealised Pressure/volume diagram of the Otto cycle showing combustion heat input Qp and waste exhaust output Qo, the power stroke is the top curved line, the bottom is the compression stroke."

"Engines based on the four-stroke ("Otto cycle") have one power stroke for every four strokes (up-down-up-down) and employ spark plug ignition. Combustion occurs rapidly, and during combustion the volume varies little ("constant volume"). They are used in cars, larger boats, some motorcycles, and many light aircraft. They are generally quieter, more efficient, and larger than their two-stroke counterparts."

"The steps involved here are:

1. Intake stroke: Air and vaporized fuel are drawn in.
2. Compression stroke: Fuel vapor and air are compressed and ignited.
3. Combustion stroke: Fuel combusts and piston is pushed downwards.
4. Exhaust stroke: Exhaust is driven out. During the 1st, 2nd, and 4th stroke the piston is relying on power and the momentum generated by the other pistons. In that case, a four cylinder engine would be less powerful than a six or eight cylinder engine."

Mechanical Description of the Four Cycle Otto Engine

Very many reciprocating internal combustion engines end up turning a shaft. This means that the linear motion of a piston must be turned into a rotation. This is typically achieved by a crankshaft.

Referring to FIG. 1: The main parts of four cycle internal combustion engine 100 in the simplified form are shown. The pistons 116, 117, 118 102, convert a linear reciprocating motion inside the cylinders (A,B,C,D) 101 into rotational motion of the crankshaft 105.

The crankshaft 105, sometimes referred to as crank, is the part of an engine which translates reciprocating linear piston motion into rotation. To convert the reciprocating motion into rotation, the crankshaft has "crank throws" or "crankpins" 106, 107, 108, 109. The crankpins have bearing surfaces whose axis is offset from that of the crank 105 by a pre-calculated distance 115. To these bearing surfaces, connecting rods 103 from each cylinder attach.

The crankshaft 105 has in line bearing surfaces which rotate within split bearings 110 which are part of the main Engine Block 111. The shaft, typically, connects at the ends to a flywheel 112 and other parts required for the proper operation of the engine. The flywheel stores rotational energy that is used to reduce the pulsation characteristic of the four-stroke cycle. Sometimes a torsional or vibrational damper 113 is connected at the opposite end of the shaft to reduce the torsion vibrations often caused along the length of the crankshaft.

The connecting rods 103 connect to the pistons with cylindrical pins to allow pivoting of the connecting rod in the process of the rotation of crankshaft.

The piston 102 moves 114 linearly up and down within the cylinder wall 101.

Transferring reciprocating motion to rotary motion was made possible by connecting the crankshaft crankpins 106, 107, 108, 109, to corresponding pistons by the connecting rods 103.

In the four cycle engine, the crankpins are arranged in pairs. For this example, 106 is paired with 107 and 108 with 109. The crankpins 106 and 107 are 180 degrees opposite to pair 108 and 109. The degree of separation between pairs for engines with more than four cylinders is less than 180 degrees around the crank axis. When one cylinder of the pair is in the compression cycle (piston moves from bottom to top) to compress the mixture of air and vaporized fuel, the other cylinder of the pair is in the exhaust cycle, (piston moves from bottom to top) to exhaust the gasses after the combustion cycle.

Referring to FIG. 2, the graph of the Pressure Volume diagram shows the four stokes of the four cycle engine.

Mixture 200 is compressed and combustion builds the highest pressure 204 at point 3 at which point the piston is forced by combustion in the downward direction. As the curve 202 shows, the pressure decreases until the piston is to its extreme down position at point 4. At that point the pressure is at its minimum and further useful work is not extracted from the pressure of gasses. The gasses at that point will be exhausted with the upward motion of the piston. The upward motion of the piston will occur with the next combustion cycle in another cylinder as the rotation is sustained. Combustion occurs every 180 degrees from the previous combustion of a different cylinder.

During the time between combustions, the stored energy in the flywheel and other mechanical parts on the crankshaft will maintain rotation. The faster the rotation of the shaft and the flywheel the more the power generated. The power generated is proportional to the energy density of the mixture inside the cylinder at combustion time. The power generated with combustion is not constant as it is shown in the power curve 202. In the four cylinder engine, the spike of power occurs every 180 degrees. The more often combustions occur within the 180 degrees of rotation the more powerful the rotation. That is, six cylinder engines are more powerful than four and eight more powerful than six and so on.

SUMMARY OF THE SYSTEM DESCRIBED HEREIN

Terminology

Each defined term is shown in its singular format, but may also be used herein in a plural format.

The term "crankshaft" or "crank" will be used to refer to that part of the engine whose motion is rotational.

The term "Master" or "Main" is used interchangeably to relate to the crankshaft that is attached to the cylinders by connecting rods.

The term "Master Crank" or "MC" will be used to describe the crank whose crankpins attach to the pistons of the cylinders and to the Load Crankpins.

The term "Load Crank" or "LC" will be used to describe the crankshaft that operates all loads attached to it. It receives its energy from the Main Crank.

The term "Load" is used to refer to the Load Crank and to the loads attached to Load Crank, such as the converter, transmission and other components.

The term "crank throw" or "crankpin" will be used to describe offset portions of the crank. Crankpin axis is parallel to the axis of rotation. It is used to attach split bearings of connecting rods.

The term "Load connecting rod" or "Load rod" is used to refer to the rod that connects the Master Crank to the Load Crank.

The term "piston connecting rod" is used to refer to the rod that connects each Master crankpin to the piston of each cylinder.

The term "Load crankpin" is used to refer to the crankpins of the Load Crank.

The term "Master crankpin" is a term applied to the crankpins of the Main Crank.

The word "Engine Block" or "Block" is referring to the solid engine body.

The term "supporting crankpin" is a term associated to crankpins that do not connect directly to pistons.

The term "bearing" will be used to describe the split bearing that is used to attach connecting rods to Master crankpins and to Load crankpins.

The term "flywheel" will be used to describe any attachment to the MC and LC to provide means for storing rotational energy. The stored rotational energy, due to inertia, is used to smooth out the power delivery over each rotation of the crank. Other required functional parts could be attached to flywheels.

It is the purpose of system described herein to provide means and methods by which the power density of a given fuel and air mixture within a cylinder will provide power due to combustion that will be multiplied in the process of being applied to a Load. The example described herein uses a four cylinder four stroke engine without diminishing the object of the system described herein if applied to other configurations of internal combustion engines and to mechanisms that convert rotational power to some other form such as electrical and or kinetic.

Multiplication of Power

The System described herein does not alter combustion for a given power density of fuel, but rather it operates as a different system of mechanical attachments to multiply overall power output generation.

The Otto engine portion, up to and not including crankshaft from the current Otto cycle engine is not the object of the system described herein.

Rather, the most noticeable difference is that the System described herein does not have the conventional load of the typical Otto engine applied to the engine crankshaft. Instead, the conventional load is applied to a different crankshaft (called a Load Crank). No load is applied to the original Otto engine crankshaft (Master Crank).

The Master Crank and Load Crank are connected with rods and include other mechanical means resulting in considerable power generation with the same given fuel density.

The descriptions of the mechanisms of the system described herein to achieve the multiplication of power are explained in greater detail in the specification of the system described herein.

Due to the arrangement of the crankpins of the Otto engine, the PUSH/PULL action on the Load Crank results in torque generation as if the crankpin of the Load Crank were twice as long as the Otto crank length.

In other words, if a power F is delivered to the load by the conventional Otto engine (with a given fuel density and other conditions), then the power delivered to the same load attached to the Load Crank with the same fuel density (and all other conditions constant) is nF where n>1.

The configuration described in the specification contains several elements to assist in the multiplication of power applied to the load:

- The Push-Pull action and multiplied force of the Master & Load crankpins work in such a way that the forces acting on the Load Crank that are moving away from the Master Crank will be the same as those forces acting on the Load Crank that is moving back towards the Master Crank. This push-pull action provides operational balance.
- By removing the transmission load from the Master Crank, the two Master Crank flywheels are no longer driving the heaviest load in the system, and provide a flywheel effect benefit to assist with continued perpetual motion of the Master Crank rotation.
- The connecting rod end bearings and roller riding surface on the Load crankpins assist the force applied to the rotation of the cranks through the benefit of the lever effect.
  - The supporting crankpins (along with their corresponding end bearings and roller riding surfaces placed at 90° to the pistons) assist rotation at the top dead center piston firing point to apply maximum force at this weakest point of the combustion cycle.

In accordance with a first aspect of the system described herein, the engine consists of a Block that internally houses crankshafts, connecting rods, cylinders, pistons, cams, and all other supporting parts vital to other components, internal or external, for proper operation. The external shape of the Block is influenced by how the internal components are housed.

In accordance with a second aspect of the system described herein, the engine includes and operates with two or more crankshafts, or cranks, as they are commonly known.

For the description of the system described herein, two cranks will be assumed without diminishing the importance and applicability of more than two cranks. In the case of two crank usage, one crank will be labeled as the Master Crank. The other crank will be labeled as the Load Crank. Naming of cranks in multiple crank applications is not included in the present description. The Master Crank and the Load Crank have the same number of crankpins to which connecting rods attach.

In accordance with a third aspect of the system described herein, for purposes of the system described herein description, each Master crankpin accommodates two connecting rods. One connecting rod is attached directly to a corresponding piston of a cylinder. The other connecting rod attaches to a corresponding crankpin of the Load Crank. In some designs, more than two connecting rods could be attached to the same Master crankpin. Design of crankpins will vary per engine design and application.

In accordance with a fourth aspect of the system described herein, piston travels linearly up and down within its cylinder. In the most up position of the piston, the fuel mixture is fully compressed. The combustion of the fuel and air mixture at the compressed state within the cylinder applies thrust energy to the piston causing it to move to its most down position. The up and down positions are determined by the length of offset of the Master crankpins from the main axis of the Master Crank. The linear motion of the piston causes rotational motion to the Master Crank. The rotational motion of the Master Crank causes reciprocating motion to the piston and rotational motion to the Load Crank.

In accordance with a fifth aspect of the system described herein, the Master Crank has main axis and attached crankpins. Said crankpins, referred herein as Master crankpins, are offset from the axis of rotation of the crank by a pre-determined distance. They are designed to accommodate split bearings of multiple connecting rods. One such connecting rod has a first end with a split bearing and a second end with a smooth circular ring. The split bearing of the rod connects to a Master crankpin and the second end of the rod connects with a circular pin of the corresponding piston.

In accordance with a sixth aspect of the system described herein, another type of connecting rod connects with a first split bearing to a Master crankpin and with a second split bearing to a Load crankpin.

In accordance with the seventh aspect of the system described herein, a connecting rod, referenced herein as the Load connecting rod, consists of a first split bearing at one end, a second split bearing at some predetermined distance away from the first split bearing, a continuation of the rod body some predetermined length extending away from the second split bearing and terminating to an end. At the termination point, a small bearing, known as the end roller bearing, can be attached.

In accordance with the eighth aspect of the system described herein, said bearing rotates against another surface at predetermined angle of rotation.

In accordance with the ninth aspect of the system described herein, instead of the bearing, the end of the Load connecting rod can be shaped and curved to provide frictionless travel against another surface during predetermined angle of rotation. The length from the center of second split bearing to the center of the end bearing of the rod is smaller than the length of the rod from the center of the first to the second split bearing. The ratio of the lengths is determined by design for best performance.

In accordance with the tenth aspect of the system described herein, the Master Crank has other crankpins, referred herein as supporting crankpins. Supporting crankpins accommodate the end split bearing of the Load connecting rod.

In accordance with an eleventh aspect of the system described herein, the Master Crank has ends that extend outside the Engine Block.

In accordance with a twelfth aspect of the system described herein, a first end of the Master Crank facilitates attachment of a first flywheel, external to the Engine Block, with gear teeth in the perimeter for starting the engine.

In accordance with a thirteenth aspect of the system described herein, the Master Crank has a second end to facilitate attachment of a second flywheel either external or internal to the Engine Block.

In accordance with a fourteenth aspect of the system described herein, the Master Crank has means to facilitate components applicable to the function of other components, such as gears and timing components.

In accordance with the fifteenth aspect of the system described herein, the Master Crank of the engine in the example has Master crankpins in pairs. Each Master crankpin of the pair is associated with a cylinder. Each pair of Master crankpins is offset to another pair of Master crankpins by 180 degrees around the axis of rotation. The crankpins of the same pair have zero degree offset between them. For other engine configurations, the degree of offset between pairs is other than 180 degrees.

In accordance with the sixteenth aspect of the system described herein, the Master supporting crankpins have an offset angle orientation suited for best operating performance. In relation to each pair of Master crankpins, the offset angle is between zero and 180 degrees. Supporting crankpins are used in pairs. Each supporting crankpin of the pair opposes the other crankpin of the same pair by 180 degrees around the axis of rotation. Supporting crankpins have a linear separation between them. The Master supporting crankpins can accommodate the split bearing of the first end of a Load connecting rod. The minimum number of supporting crankpins will be one pair.

In accordance with the seventeenth aspect of the system described herein, a second crankshaft or crank, referred herein as the Load Crank, is used. The Load Crank has Load crankpins and Load supporting crankpins. The Load Crank and the Master Crank are identical in crankpins and orientation of same. Other sections of the Load Crank not associated with crankpins can be different than the Master Crank if the design requires it. The distance of point of rotation between both cranks is determined by design. The distance between the split bearings of the Load connecting rod is equal to the distance of point of rotation between both cranks.

In accordance with a eighteenth aspect of the system described herein, rotational power derived from sources other than internal combustion means can be multiplied by application of Master Cranks and Load Cranks as described in this system. The number of crankpins of each crank incorporated in each design is determined by each application.

In accordance with the nineteenth aspect of the system described herein, the engine could have more than one Load Crank connected to the Master Crank. The connections and operation of each additional Load Crank is a duplicate of the one described in detail of the system described herein.

In accordance with a twentieth aspect of the system described herein, three crankshafts are used. One crankshaft, the Main, is connected to the cylinders. The other two, the Load Cranks, are placed one on each side of the Main at predetermined distance. All cranks are connected with Load connecting rods at corresponding crankpins. Both Load Cranks at the same end bear a tooth gear. The tooth gears are engaged to a third gear, the Load gear, which is used to drive the converter and transmission along with other required components. The rotational power derived from combustion drives all three cranks in the same rotation. However, the Load gears are driven in a push/pull mode.

In accordance with the twenty first aspect of the system described herein, the length of the Load crankpin and the corresponding crankpin that is part of the Master Crank are equal in offset length and longer than the offset of the Master crankpin that connects to the cylinder connecting rod.

In accordance with a twenty second aspect of the system described herein, there exists a phase relationship between the crankpin of the Master Crank that connects to the cylinder connecting rod and the crankpin of the Master Crank that connects to the corresponding crankpin of the Load Crank.

BRIEF DESCRIPTION OF THE DRAWINGS

These, and further features of the system described herein, may be better understood with reference to the accompanying specification and drawings depicting the embodiments described herein, in which.

The arrangement of the cylinders, pistons, connecting rods, supporting blocks and other components shown herein are for demonstration of the operation.

Figure 1:
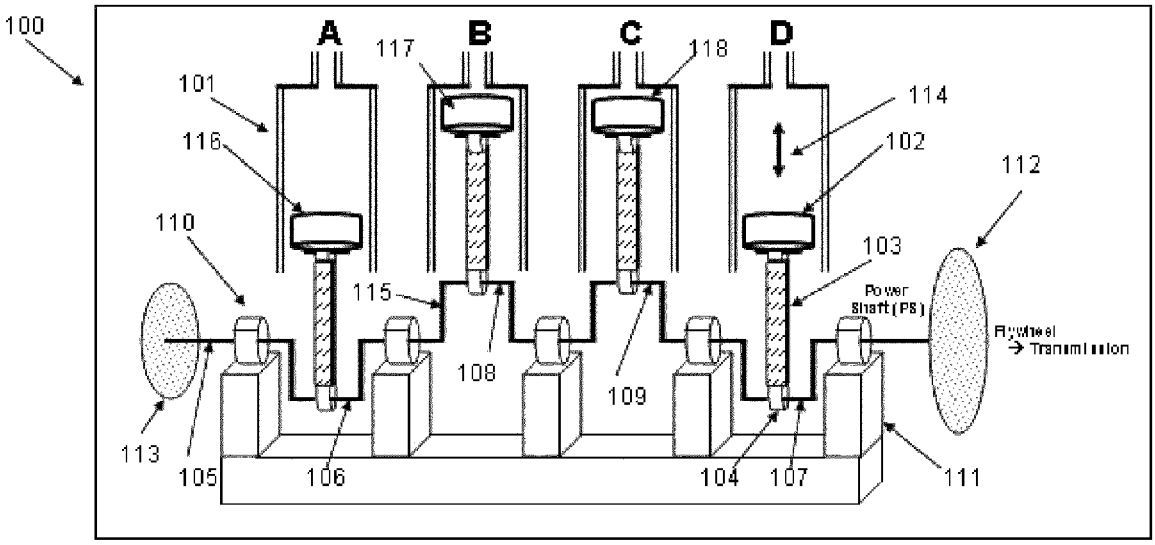
FIG. 1 PRIOR ART
FIG. 1 depicts a typical prior art four cylinder engine.
Figure 2:
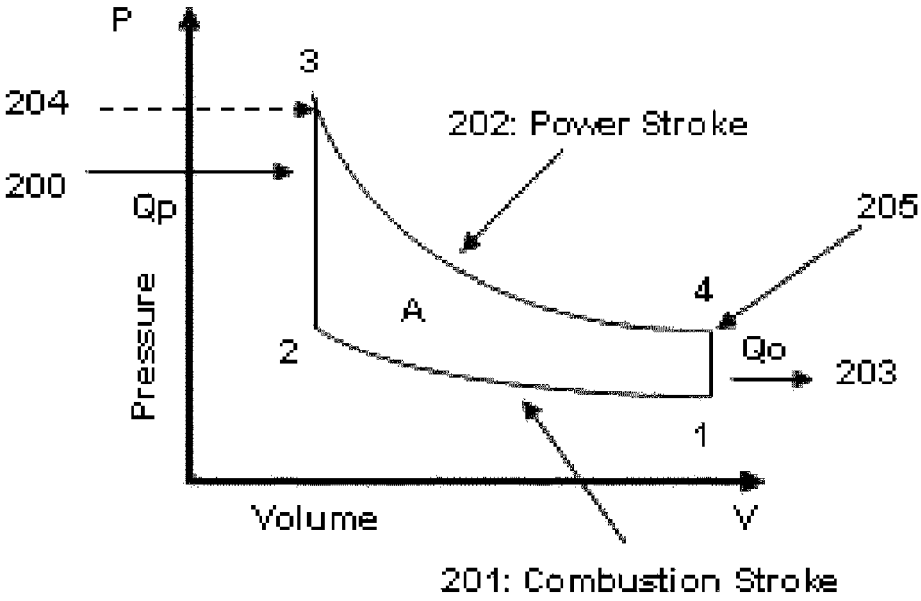
FIG. 2 PRIOR ART

FIG. 2 depicts a typical prior art Pressure Volume diagram describing the relationship of Pressure to Volume for the four strokes of the internal combustion engine.

Figure 3:
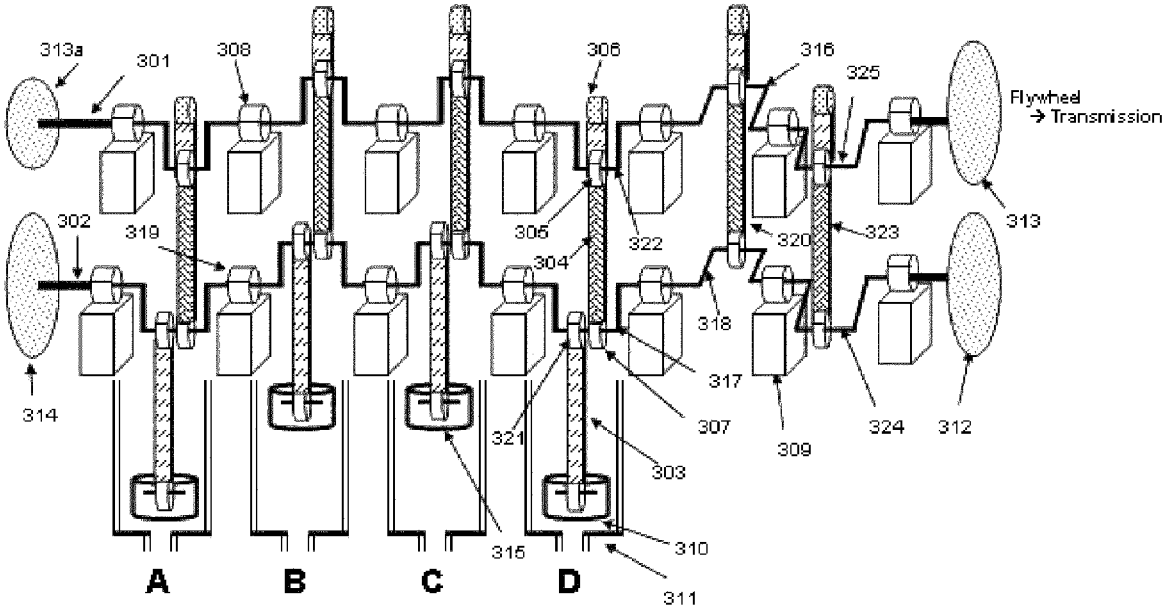

FIG. 3 depicts the four cylinder engine. It depicts the two crankshaft arrangement with associated crankpins. One crankshaft associated with the pistons and cylinders is the Master Crank. The other crankshaft is the Load Crank that runs the loads attached to it. It also depicts the supporting crankpins of both cranks.

Figure 4:
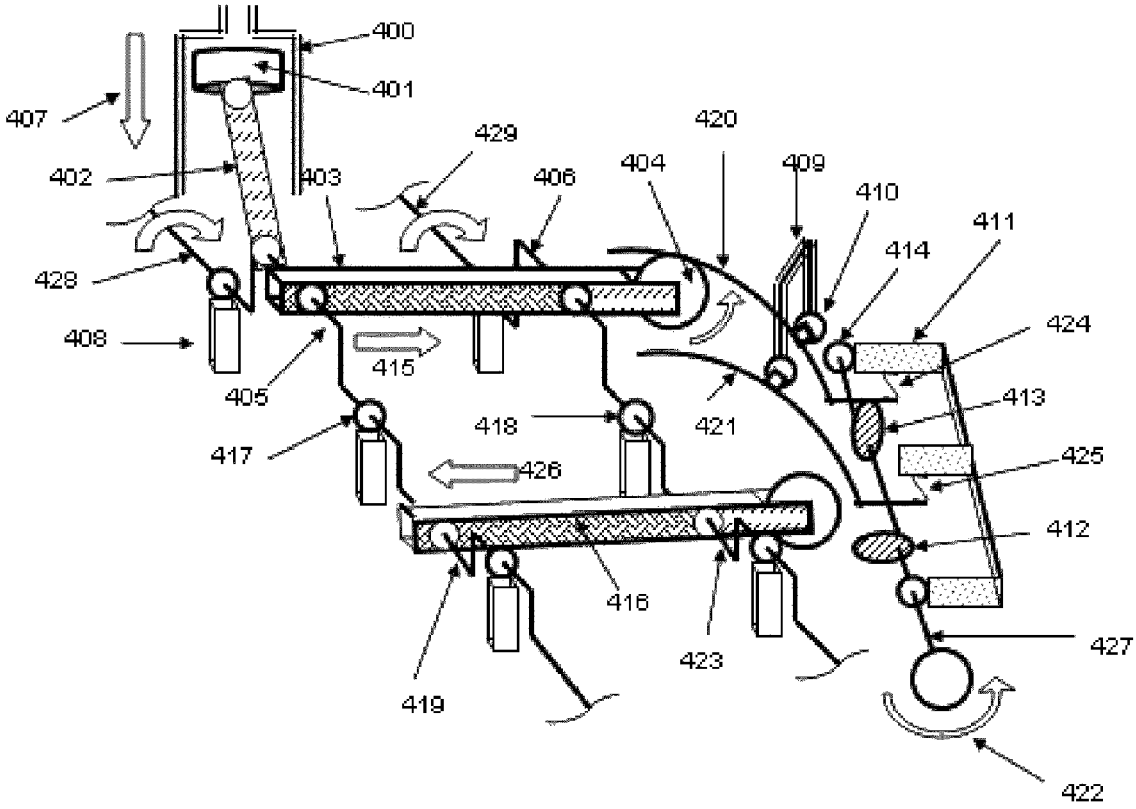

FIG. 4 depicts two Load connecting rods with the associated cranks, one cylinder with its piston and crank rotation with piston downward motion. It also shows how the end bearing of each connecting rod is controlled by a curved surface with cams to provide lever action to help maintain continuous downward motion.

Figure 5:
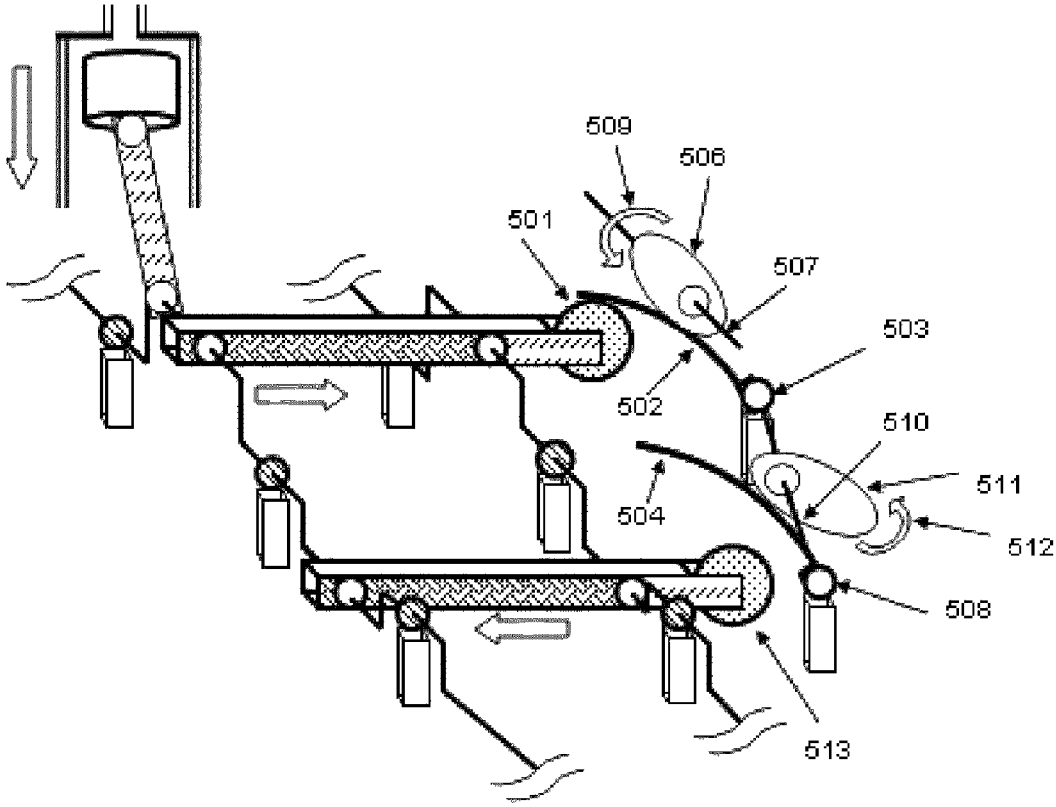

FIG. 5 depicts an arrangement with a different version of cams to control the end roller bearing of the Load connecting rods.

Figure 5A:
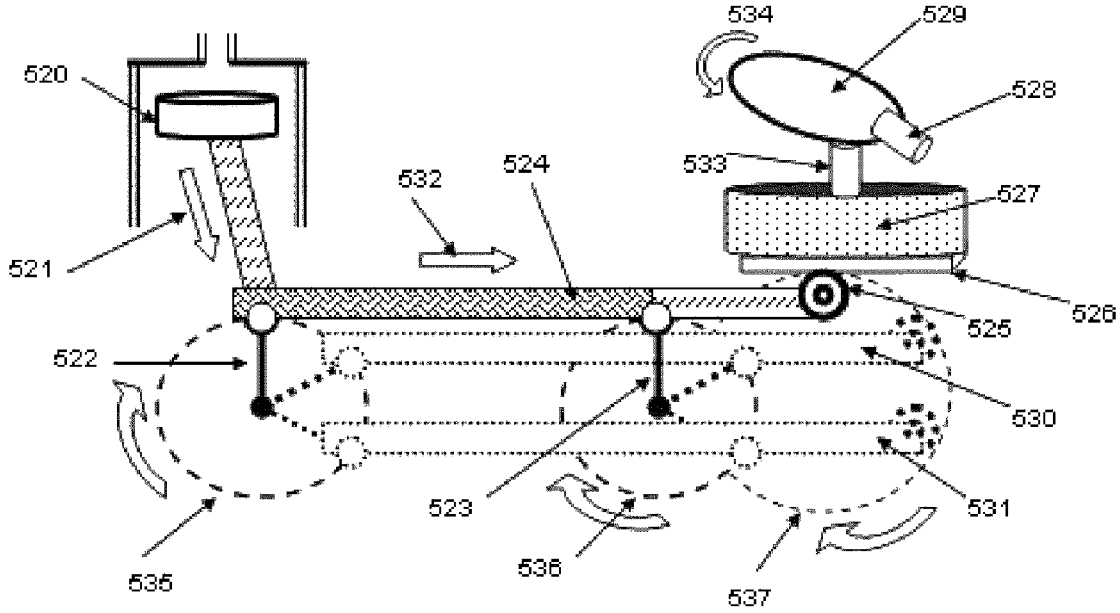

FIG. 5A depicts an arrangement of parts of a mechanism to push the roller bearing of the Load connecting rods to a downward motion in order to maintain a continuous fulcrum for a quarter cycle.

Figure 5B:
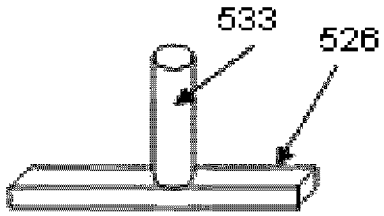

FIG. 5B depicts the plunger of FIG. 5A.

Figure 6:
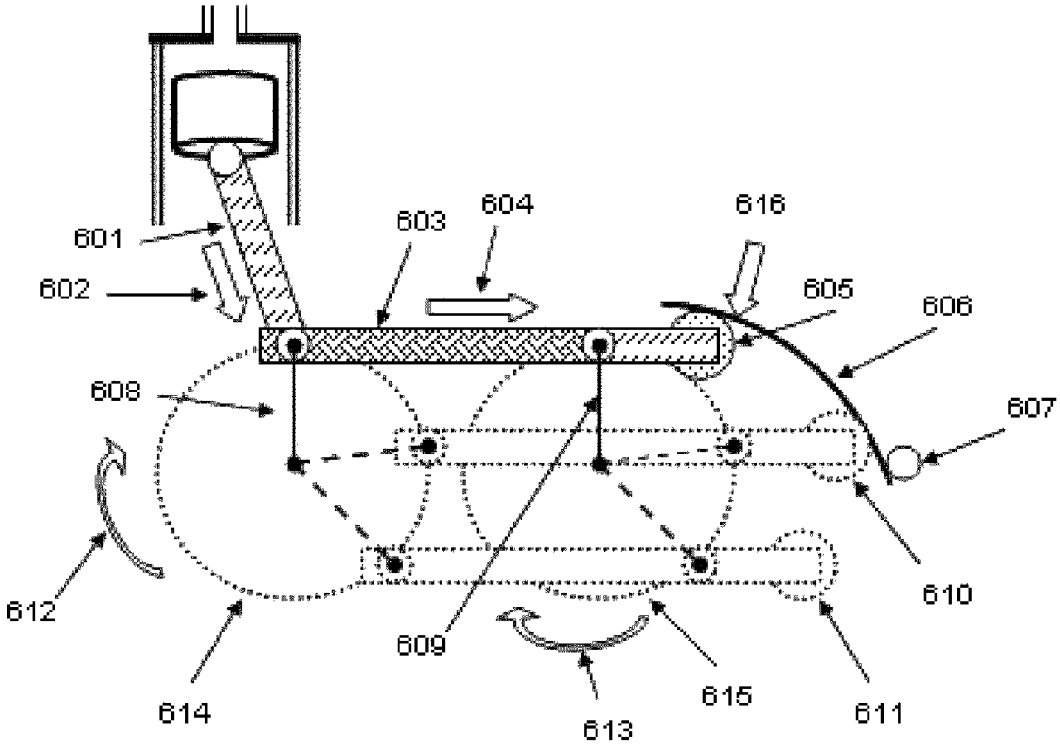

FIG. 6 depicts Load connecting rod motion and the curvature of the roller bearing controlling lever.

Figure 7A:
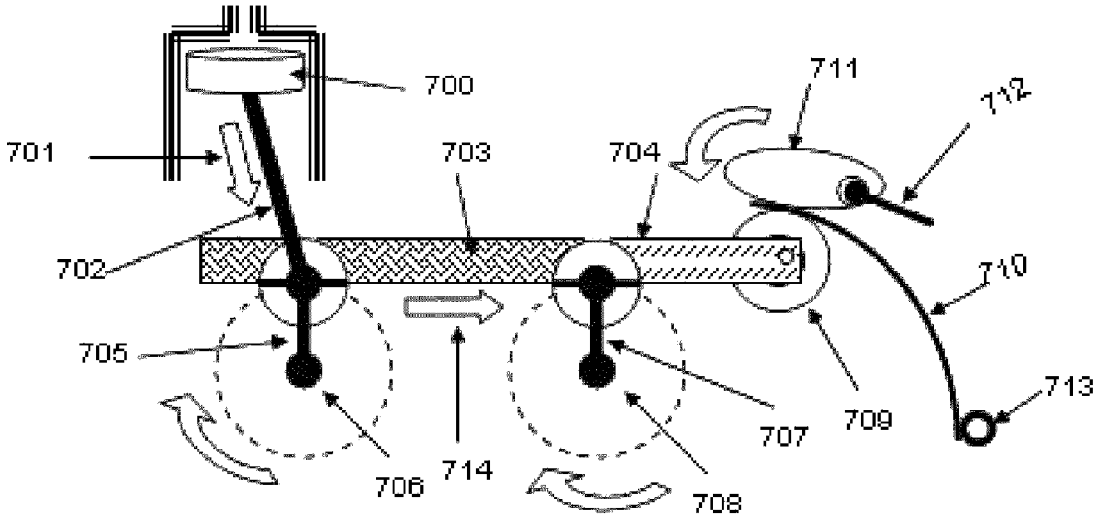

FIG. 7A depicts a version of the new art rotation of cranks and their association with Load connecting rod. In addition, it shows roller bearing controlling lever with cam.

Figure 7B:
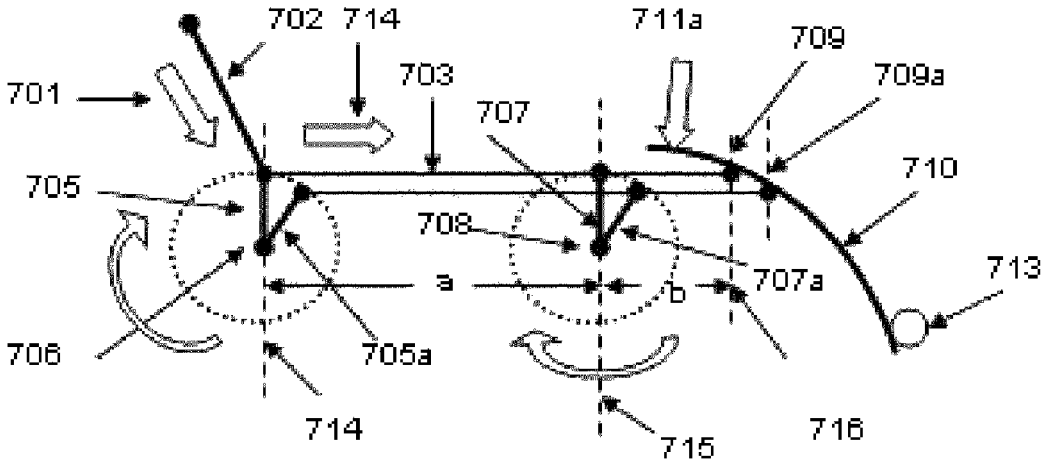

FIG. 7B depicts the geometric relationships of the Load connecting rods and the roller bearing controlling lever.

Figure 7C:
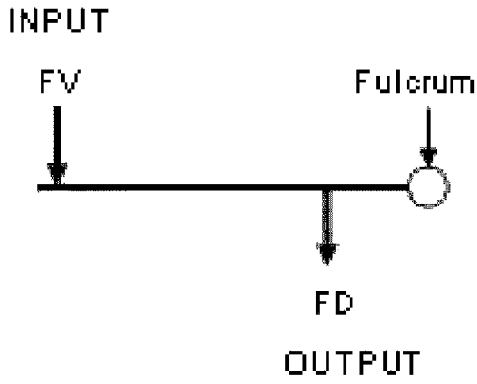

FIG. 7C depicts the resulting second class lever.

Figure 8A:
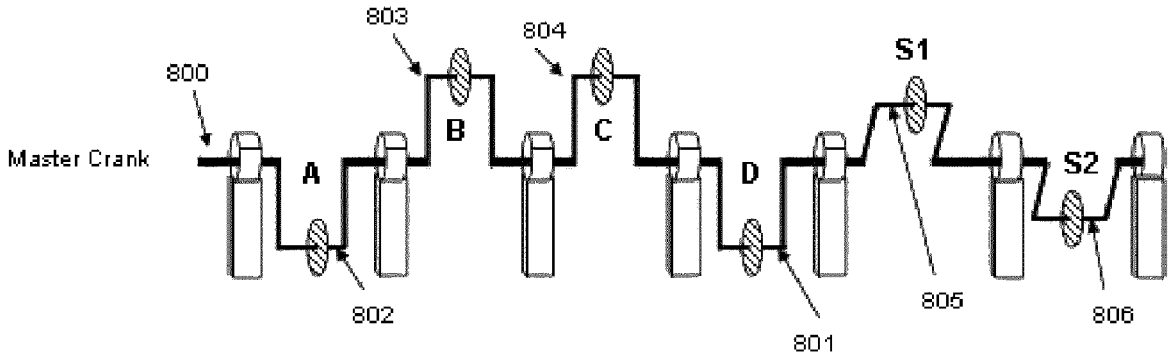

FIG. 8A depicts a version of the new art four cylinder crankshaft with the arrangement of the Main crankpins and supporting crankpins.

Figure 8B:
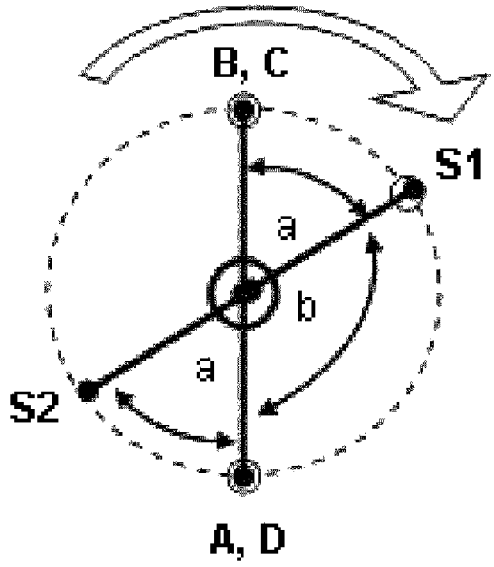

FIG. 8B depicts the main crankpin angular relationship to the supporting crankpins.

Figure 8C:
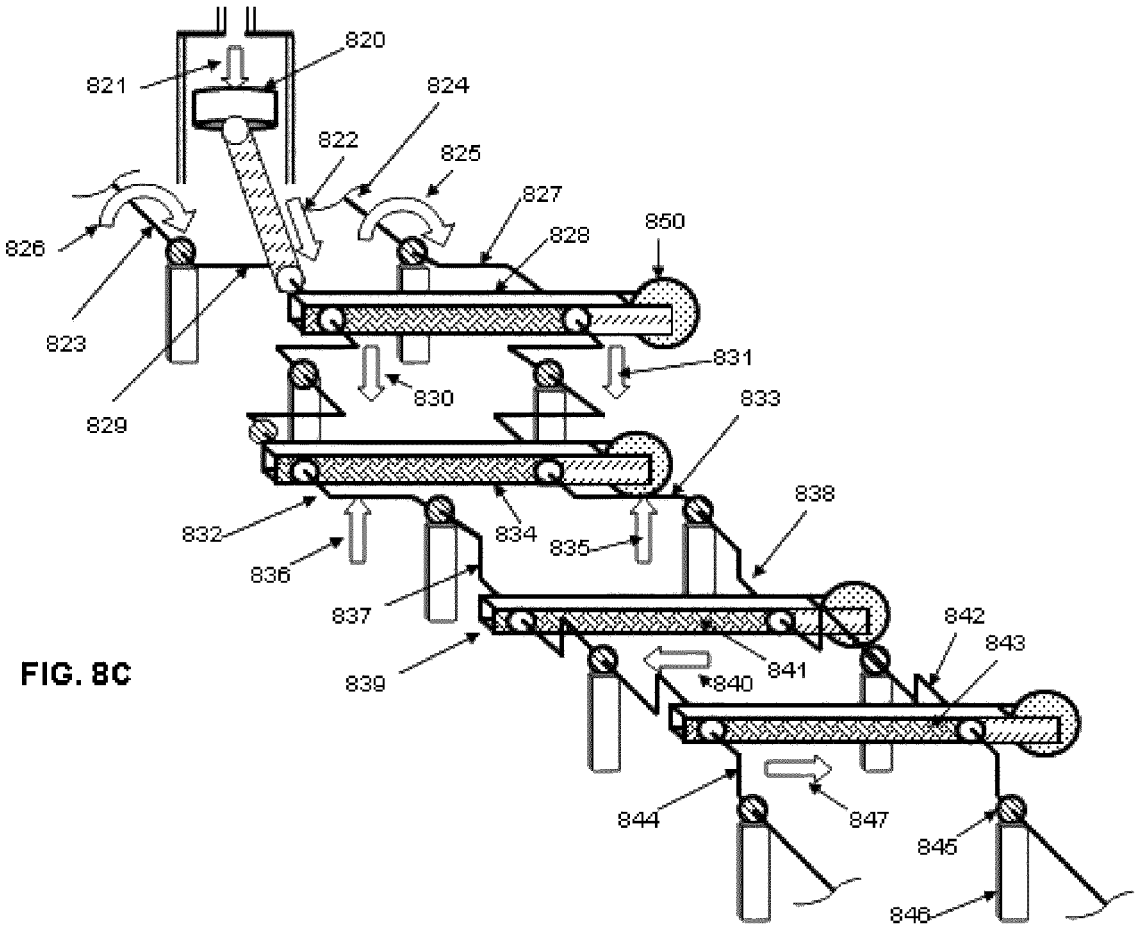

FIG. 8C depicts the relationship of the Main crankpins to the supporting crankpins at the point of rotation where the Main crankpins are on the same horizontal plane and the supporting crankpins are perpendicular to the horizontal plane.

Figure 9A:
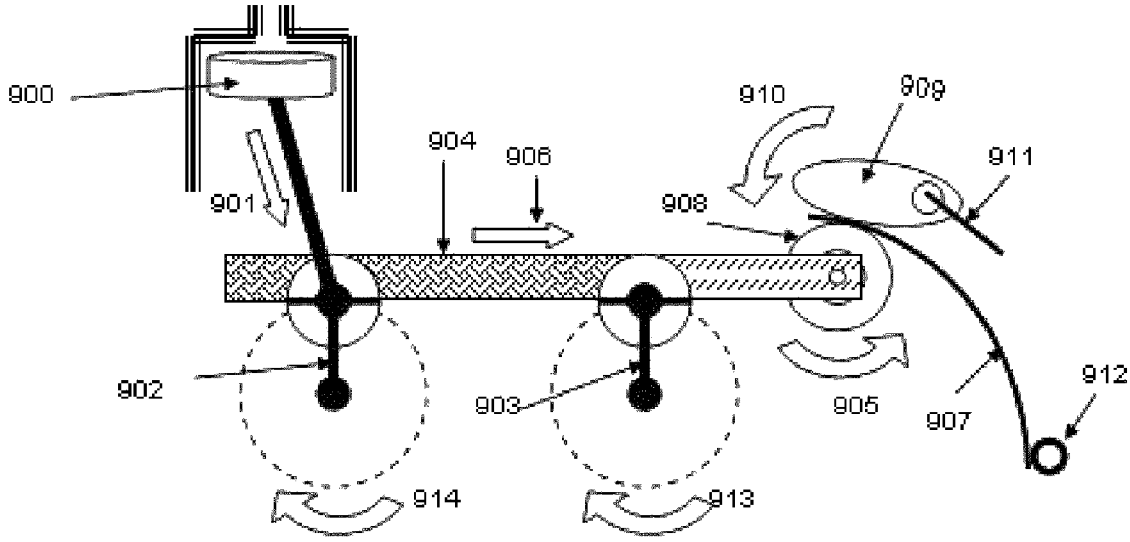
Figure 9B:
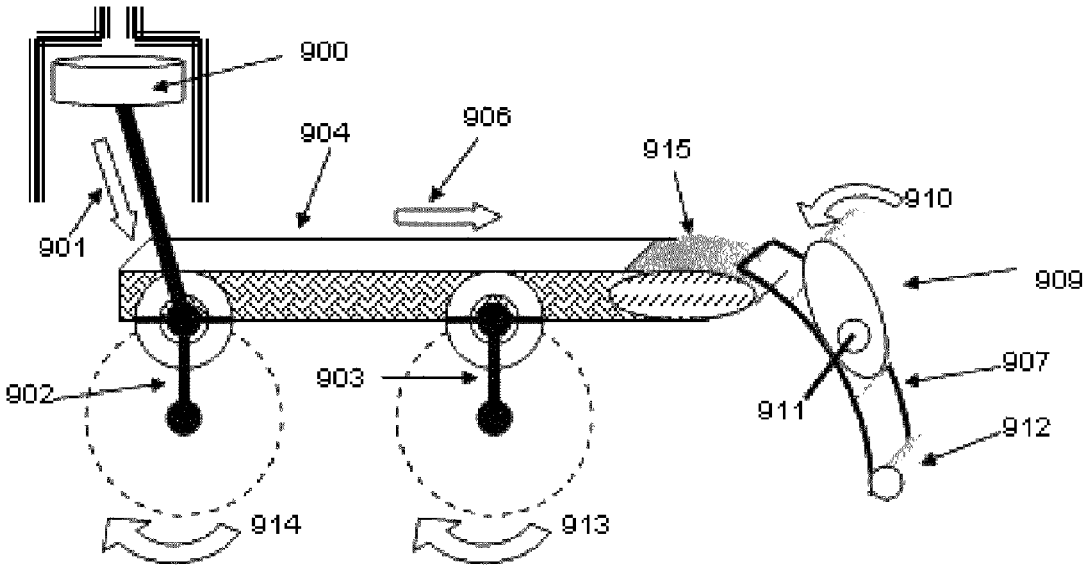

FIGS. 9A and 9B depict the different designs of the extending end of the Load connecting rods.

Figure 10:
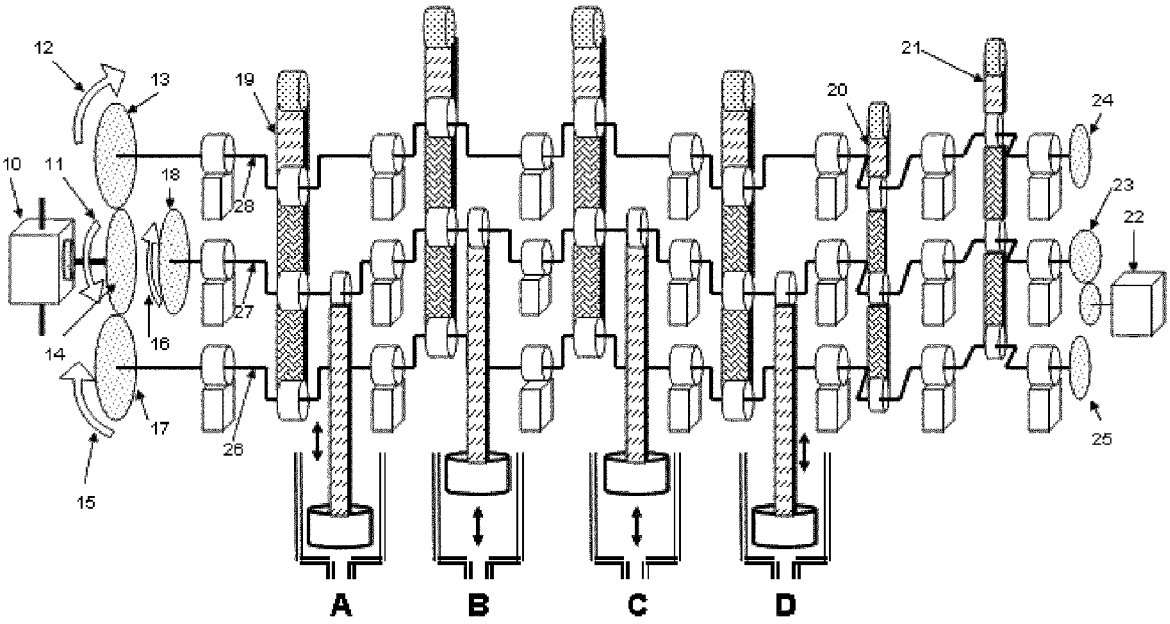

FIG. 10 depicts a variation of the new engine that is constructed with three crankshafts.

Figure 10A:
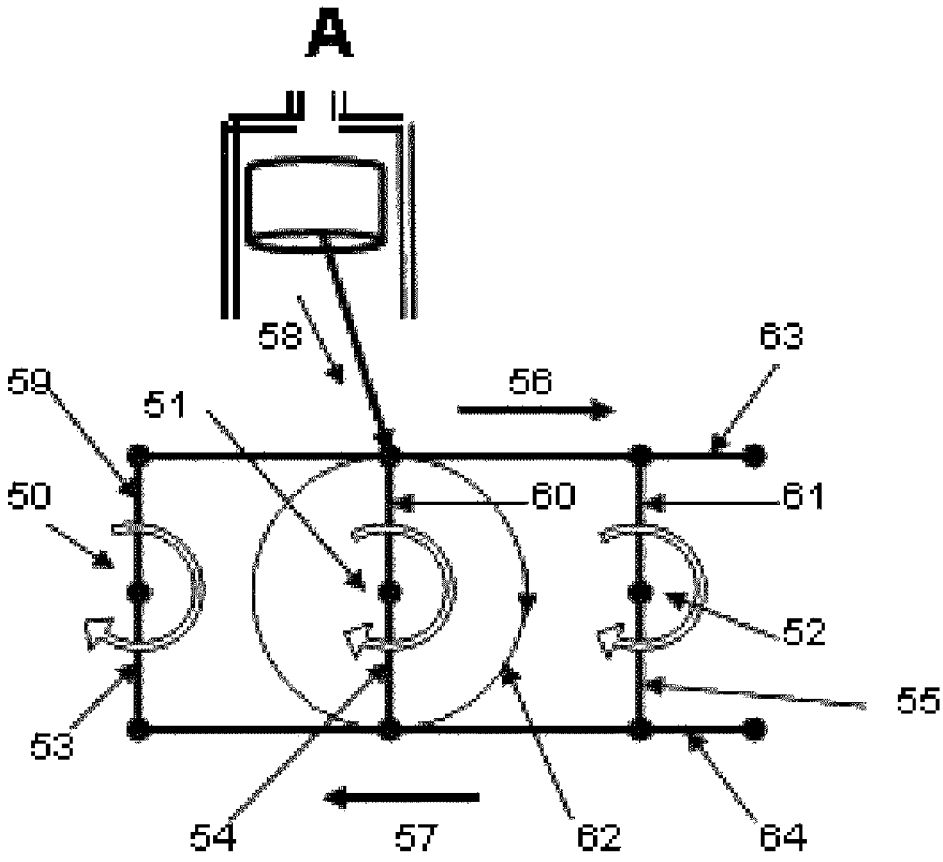

FIG. 10A depicts a side view of the three crankshafts with the connecting rods and connection to a cylinder for demonstration of rotation.

Figure 10B:
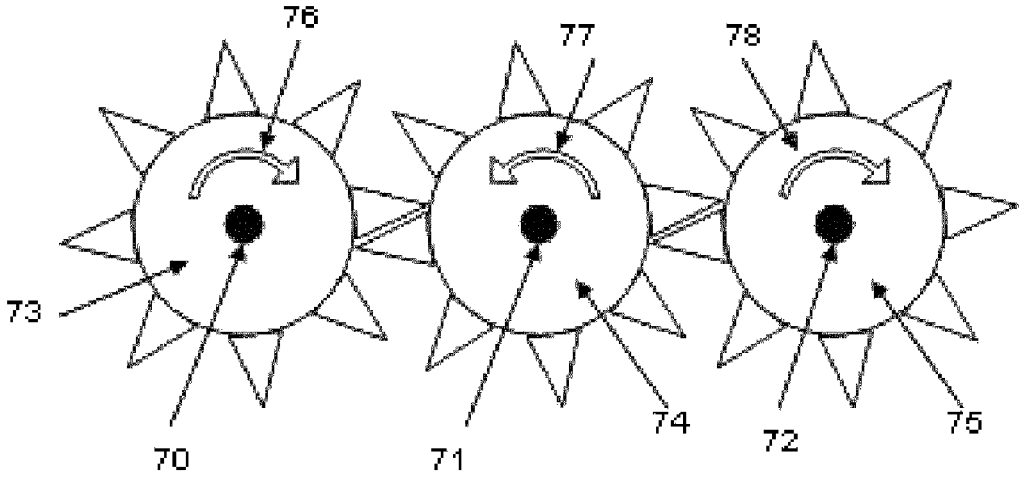

FIG. 10B depicts a side view of axis of the two crankshafts not associated with the cylinders, gears attached and a gear driven by the crankshaft gears.

Figure 11:
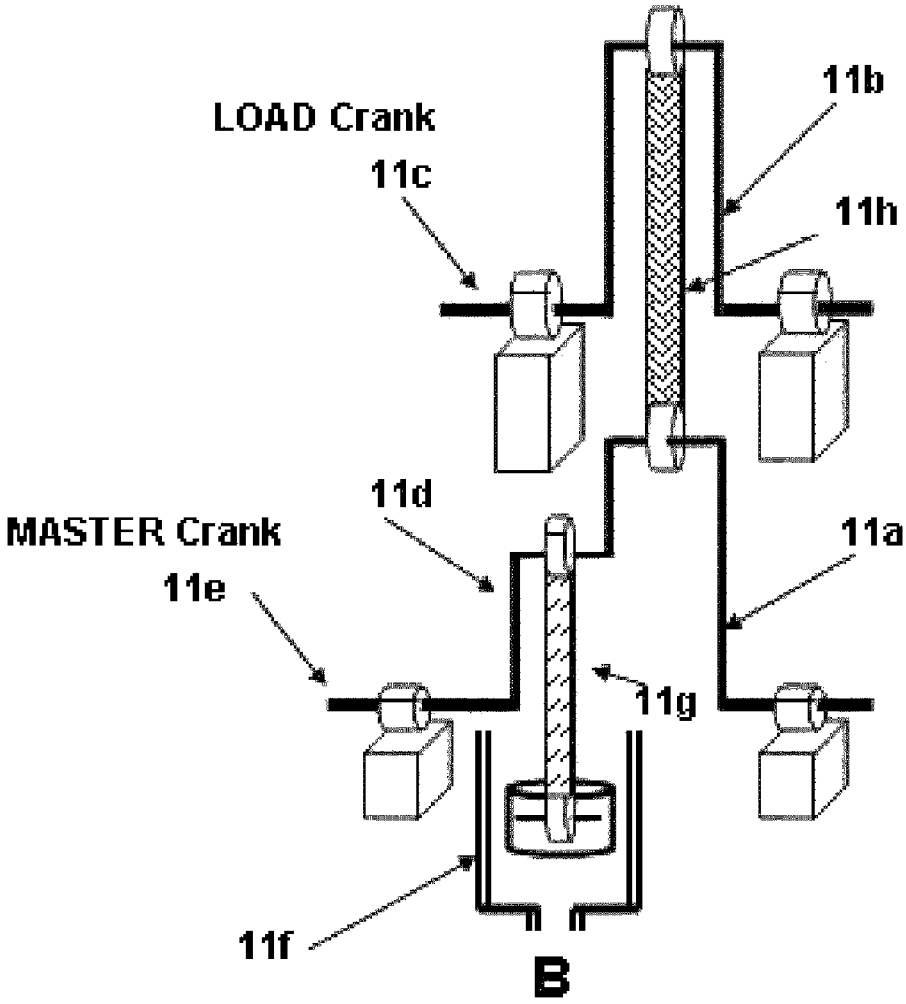

FIG. 11 depicts Master crankpin length and Load crankpin length. The Master crankpin is a single unit that incorporates the cylinder rod connection and the connection of the rod between the Master crank and the Load Crank. The length of the Load crankpin is longer than the Master crankpin.

Figure 12:
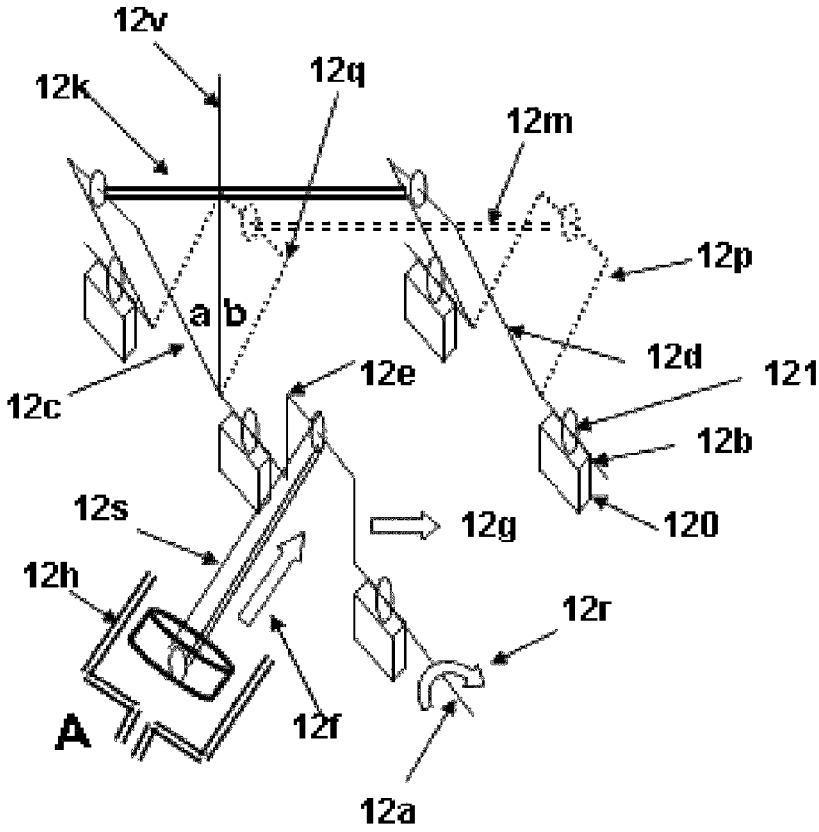

FIG. 12 depicts the phase relationship between the crankpin of the Master Crank that connects to the cylinder connecting rod and the crankpin of the Master Crank that connects to the corresponding crankpin of the Load Crank.

DESCRIPTION OF THE SUGGESTED EMBODIMENTS

The system described herein is better explained by reference to drawings described above, and to the detailed descriptions of the system described herein.

Detailed Description of the New Engine

Reference to attached drawings will follow for the detailed description.

For description of the system described herein, a configuration of a four cylinder engine will be used without exclusion of other configurations of internal combustion engines and other mechanisms that provide rotational energy as an input to the engine or mechanism of the system described herein.

Referring to FIG. 3 (in accordance with all aspects of the system described herein) the new four cylinder engine described herein is shown in a simplified drawing.

Two cranks 301 and 302 are employed. Crank 302 is the Master Crank. It is the only crank that is associated directly with the four cylinders A, B, C and D. It has four crankpins 317 associated with the four pistons 310 of the four cylinders 311 (A, B, C, D).

A connecting rod 303, one for each piston 310, connects one end with split bearing 321 to each crankpin 317. The ring of the other end of each connecting rod 303 connects, by a round pin, to each piston 310.

The main rotational axis of crank 302 rotates inside split bearings 319. The split bearings 319 are housed in slots of the main block of the engine indicated herein as blocks 309.

All blocks 309 on this drawing are part of the Engine Block. For reasons of description, blocks 309 are shown as separated from each other.

At the ends of Master Crank 302, flywheels 312 and 314 are attached. Either flywheel can have a ring gear to serve for starting the engine. The other flywheel may or may not be necessary. Other supporting parts, such as timing gears, cams and pulleys, not shown in this drawing can be attached to Master Crank.

The crankpins 317 associated with the four pistons 310 are arranged in pairs. The crankpins of each pair have zero degrees offset between them. The pairs, between them, have 180 degrees separation around the axis of rotation. When the pistons of cylinders B and C are in the most down position 315, the pistons of the cylinders A and D are in the most up position 310.

Crankpins 318 and 324 are not associated with any piston. They are designated as supporting crankpins. The offset orientation of crankpins 318 and 324, in relation to each pair of crankpins 317, is established by design. The number of 318 and 324 crankpins depends on space availability, cost and performance requirements. The minimum number of 318 and 324 crankpins for each crank is two. This will be explained in a later description.

Crank 301 is labeled as the Load Crank. In one design it is identical to crank 302. In another design, the crankpins of the Load Crank could have different axis length to which connecting rod split bearings attach. However, the number of crankpins, their offset axis and orientation is identical to crank 302.

Supporting crankpin 316 and 325 are identical to 318 and 324 in shape, size, bearing distance and orientation.

At one end of crank 301, a flywheel 313 is attached. To this flywheel, not shown, a converter is attached to drive the transmission. At the other end of the crank, pulleys 313*a* are attached to drive auxiliary components, such as alternators, water pump, compressors steering pumps and other.

The two cranks 301 and 302 are parallel to each other and are connected together with connecting rods 304, 320 and 323 at corresponding crankpins. Connecting rods 304, 320 and 323 could be identical in geometries and function as the design may require.

Connecting rods 304 are unique. At one end, they have a split bearing 307 to connect to the crankpin axis 317 along side to split bearing 321 of connecting rod 303 associated with each piston. At a distance equal to the separation of bearings 308 and 319 of cranks 301 and 302, there is another split bearing 305 to connect to the corresponding crankpin 322 of the Load Crank 301. All Load connecting rods have the same geometrical characteristics. For simplicity, without departing from the system described herein, not all rods, crankpins and bearings are numbered.

Connecting rods 304 extend beyond the split bearing 305 that connects to each crankpin of crank 301 Each one terminates to a roller bearing 306 or to a curved smooth surface. The distance between roller bearing 306 to split bearing 305 and the function will be explained in other drawings herein. Connecting rods 320 and 323 may or may not extend beyond the split bearing. If they do, they may be similar to rods 304.

Instead of a roller bearing, a smooth curved surface at the end of each Load rod could be formed. A separate part 915 with curved and smooth surface could be attached at the end of each Load rod to take the place of the roller bearing 908. Drawings are shown in FIGS. 9A and 9B.

Referring to FIG. 4, a section of the new art engine is shown. For demonstration, a cylinder 400 with piston 401 and connecting rod 402 is connected to a crankpin 405 of the Master Crank 428. Two Load connecting rods 403 and 416 are connected with their one split bearing to crankpins 405 and 419 of the Master Crank. Crankpins 405 and 419 are 180 degrees apart around the Master Crank axis. With their other split bearing, they connect to crankpins 406 and 423 of the Load Crank 429. Crankpins 406 and 423 have the same orientation and position on the Load Crank as crankpins 405 and 419 on the Master Crank. Both cranks rotate around all crank split bearings similar to 417 and 418 respectively.

Roller bearing 404 attached to the end of the Load connecting rod 403 is allowed to spin freely. All roller bearings at the end of the respective Load connecting rods are allowed to spin freely. There are two curvy surfaces 420 and 421 shown herein for explanation. They make contact with the end roller bearings 404 respectively. The rollers start contacting with surfaces 420 and 421 respectively, in this case, at the most up position of the rotation. Optimal point of contact will be decided at engine design time. For best performance, the exact point of contact is established at engine design time.

For this example, the curvy surfaces pivot at points 410 respectively. Pivot points are supported by solid supports 409 which are part of the Engine Block. Section 411 is also part of the Engine Block. The shape of supports shown herein is only for demonstration.

Surfaces 420 and 421 are controlled by cams 413 and 412 respectively. These cams, rotated by shaft 427, are timed appropriately to cause 420 and 421 respectively to start applying downward pressure to rollers 404 when they engage.

For this example, the ends of surfaces 420 and 421 are controlled by springs 424 and 425 or some other means to make them return to a normal non functional position.

This arrangement of surfaces 420 and 421 is only one of the many implementations that could be implemented. Herein it is used for explanation purposes. In no way they represent the only solution to applying pressure to rollers 404.

The downward motion 407 of piston 401 causes rod 403 to travel in direction 415 and the rod 416 to direction 426. This action produces push pull forces to be applied to the Load Crank by virtue of crankpins 406 and 423.

Referring to FIG. 5, surfaces 502 and 504, having pivot points 503 and 508 as part of the Engine Block, are controlled by cams 506 and 511 attached to shafts 507 and 510 respectively. They are timed on the shaft to apply the downward pressure to roller bearings 501 at appropriate times. Cam direction of rotation 509 and 512 is shown. FIG. 5 demonstrates an alternate method to FIG. 4.

Referring to FIG. 5A, an alternate method for controlling the downward motion of the roller bearing of the Load connecting rod is shown.

Motion of piston 520 in downward motion 521 pushes Master crankpin 522, rod 524, Load crankpin 523 and roller bearing 525 in the direction 532 to start the circular motion indicated by traces 535, 536 and 537. Position shown is the most vertical one. At this point, the top of the roller bearing 525 makes contact with plate 526.

A shaft 533 attached to plate 526 starts the down motion through a circular housing of block 527 by control of cam 529 and its rotating shaft 528 in direction 534. The plate 526 will apply pressure to roller 525 for a quarter cycle of trace 537. This action will cause the roller to be the continuous fulcrum along the trace.

FIG. 5B is a simplified drawing of the plunger with shaft 533 and plate 526.

Other methods can be used to control the fulcrum creation without diminishing the system described herein.

Referring to FIG. 6, downward pressure 602 of rod 601 will move rod 603 in the direction 604 and crankpins 608 and 609 will follow circular rotations 614 and 615 in directions 612 and 613. Roller 605 will ride against surface 606 for only a quarter of a cycle with the last point of contact shown at position 610. Afterwards, it will be free as shown at point 611. Contact of the roller 605 to surface 606 is assured if pressure is applied at some point 616 by some mechanism. Point 607 is a fixed point of rotation attached to the Engine Block. Surface 606 could be fixed to the block to provide a continuous fulcrum point.

Referring to FIG. 7A, downward pressure of piston 700 will apply pressure 701 to rod 702 which will move rod 703 in the direction 714 and crankpins 705 of the Master Crank 706 and crankpin 707 of Load Crank 708 to follow circular rotations as shown by the fat arrows. Roller 709 will ride against surface 710 for only a quarter cycle. Afterwards, it will be free and away from surface 710. Contact of the roller 709 to surface 710 is assured if pressure is applied by cam 711. Shaft 712 attached to cam 711 is a shaft of rotation attached to the Engine Block. Surface 710 could be fixed to the block and designed in such a way to apply a continuous fulcrum point as the roller moves horizontally and vertically.

Referring to FIG. 7B, the geometries of the connecting rod 703, its motion and the principles of the mechanism are hereby examined.

The geometry of the connecting rod 703 is such so that the main section (a) has length equal to a multiple of the length (b) or a=xb.

The value of (x) for best performance is determined at design time.

The circular motion of the crankpins 705 of crank 706 and 707 of crank 708 make the end of roller bearing 709 to scribe the same circular motion as the crankpins.

The top of the roller bearing that makes contact with surface 710 robs against the smooth face of 710.

A force is exerted on surface 710 by the rotation of the cam 711 in such a way so that a direct vertical force 711*a* is applied to the top of the roller bearing causing it to move downward. This adds to the downward component of force derived by the circular motion of the cranks.

The force exerted on the piston 700 by the expansion of the gases by combustion of the fuel mixture, is transmitted downward the cylinder and to the connecting rod 702 and is applied at the axis point of the Master crankpin.

The maximum force is available at the axis of crankpin 705 and is transferred to connecting rod 703 when the piston is at about the beginning of its downward motion as it is indicated as the maximum pressure point (3) in FIG. 2.

Since the crankpin is part of the Master Crank, its motion is constrained to be rotational. The slippery surface of the Master Crank split bearing causes most of the energy to be transferred horizontally by the Load connecting rod to the crankpin 707 of the Load Crank.

At this point, the force applied to the Load crankpin generates the maximum rotational force on the Load Crank. The force on the connecting rod is perpendicular to the axis of the Load crankpin and does not break down to horizontal and vertical components. As the rotation continues, the applied rotational force to the crankpin diminishes due to reduction of pressure as shown in FIG. 2. The force on the Load connecting rod breaks down to horizontal and vertical components.

At the Master crankpin 705 point, the force has two components, a horizontal one designated as FH and a vertical one designated as FV. The FV component is perpendicular to the connecting rod 703 at the Master crankpin axis connection.

The force at the top of the roller bearing 709 is, also, vertical and causes a fixed point of downward pressure at the direction of rotation for one quarter of the rotation.

An output downward force designated as FD is exerted at the point of the Load crankpin 707 axis.

Referring to FIG. 7C, the generated output force FD as applied to the axis of the Load crankpin 707 is much greater than the FV force applied at the input point which is the axis of the Master crankpin. This is due to second class lever principle. The FD force will cause the Load Crank to rotate faster. Lengths (a) and (b) are determined at design time for best performance of the engine.

The cylinder of the pair not in compression is in the exhaust stroke. The Load connecting rods of both crankpins in the pair are moving in parallel. Both end roller bearings will see the same downward force applied by the downward movement of contacting surfaces. Therefore the FD force will be twice as large. This will cause faster acceleration of the rotation.

As the piston travels downward, the horizontal force on the connecting rod 703 diminishes and the component FV at crankpin location 705*a* becomes smaller and will continue to decrease as the piston bottoms out in the cylinder.

Because of the lever action, the incremental, due to rotation, downward circular direction 707*a* of the Load crankpin axis 707 will see a downward force FD larger than FV applied at Master crankpin axis 705*a*. The amount of output FD will be proportional to the force FV and the distance (a) between the two cranks.

The fulcrum location will change continuously in the direction of the circular trace of the roller contact to the surface 710 for quarter cycle. This will maintain the lever function.

Any method, not described herein, and used to provide a continuous fulcrum does not diminish the system described herein.

The maximum Load Crank torque is the product of the horizontal force applied at the axis of the Load crankpin perpendicular to the applied force.

If the force (f) is applied to the axis of Load crankpin with length (d), the resulting torque (T) on the Load Crank is T=fd foot-pounds.

As shown in FIG. 3, the cylinders are in pairs B and C, and A and D.

As described and shown in FIG. 4, when a piston 401 is at the highest compression point, the corresponding Master and Load crankpins 405 and 406 respectively, are at about their most vertical position. The crankpins associated with the other cylinder of the pair, are also in their most vertical position.

The crankpin of each cylinder in the pair not involved in compression stroke is 180 degrees in opposing direction to the one in compression.

In FIG. 4, as the piston 401 moves downward by combustion, the Load connecting rods 403 of that pair move in direction 415. Load connecting rods 416 of the other pair move away from the Load Crank.

The opposing direction 415 and 426 of the Load connecting rods 403 and 416 causes a Push/Pull action on the Load Crank.

The force generated by the downward motion of the piston is applied to all crankpins of the Master Crank trough out the length. Consequently, all the Load connecting rods and Load crankpins see the same rotational force. The Load crankpins that create Push/Pull action to the Load Crank produce twice the torque on the Load Crank. Therefore, T=f(2d).

By the angle placement of the four crankpins on the Master Crank and Load Crank, there are two pushing rods and two pulling rods at any give time of the cycle. With more pairs of crankpins on the Master Crank and Load Crank, there are more pushing and pulling actions.

Aside from the crankpins associated to cylinders, there are other crankpins not related to cylinders. These crankpins are referred herein as supporting crankpins.

Referring to FIG. 8A, a Master Crank with cylinder related and supporting crankpins is shown. If one were to take the four 802 A, 803 B, 804 C, 801 D crankpins and lay them down on a horizontal plane, all four crankpins will be on the plane. Crankpins 801 and 802 are 180 degrees opposite to 803 and 804. The supporting crankpins S1 and S2 are perpendicular above and below the horizontal plane. A different angle could be used if it proves more beneficial for the functionality of the engine.

Referring to FIG. 8B, the angle (a) between S1 and BC and S2 and AD is shown for demonstration to be other than 90 degrees.

Referring to FIG. 8C, Main crankpins 829 opposing 832 and supporting 837 opposing 844 for the Master Crank and Main crankpins 827 opposing 833 and supporting 838 opposing 842 for the Load Crank are shown. 829 and 827 are connected with Load rod 828 and 832 and 833 are connected with Load rod 834.

Supporting crankpins 837 and 838 are connected with Load rod 841 and supporting crankpins 844 and 842 are connected with Load rod 843.

Both cranks 823 and 824 are rotating through bearings 845 supported by same block 846 in the same direction 826 and 825.

At 90 degrees of rotation rods 828 and 834 are parallel on the same horizontal plane. Crankpins 829 and 827 are in the downward direction 830 and 831. At the same time, crankpins 832 and 833 are in the upward 836 and 835 direction.

Conversely, supporting crankpins 837 and 838 move in 840 direction and 844 and 842 move in the 847 direction.

When rods 828 and 834 are in the horizontal position moving in opposite direction, the downward force supplied by the piston 820 is substantially reduced. At this point, the continuation of crank rotation is depended mostly on existing rotational momentum and very little on the downward motion of the piston.

To further help in the rotation, the supporting crankpins in the Push/Pull mode of the rods 847 and 841 will increase the force of rotation due to rotational momentum and the application of the remaining downward force of the combustion. The force supplied by the connecting load rods 847 and 841 is perpendicular to the crankpins and at that point they supply the maximum force to the rotation of the cranks.

This action will help smooth the rotation between 180 degrees of firing of the cylinders.

Referring to FIGS. 9A and 9B, the two versions of Load connecting rod 904 is shown. The extension portion of the rod from Load crankpin to the position of the roller is either constructed to include a roller bearing 908 or a formed smooth section 915. The function of both versions is to provide a continuous fulcrum for a quarter cycle rotation.

Referring to FIG. 10, the three crank arrangements 26, 27 and 28 are shown. Crank 27 is the Main crank that is connected to the cylinders. Cranks 26 and 28 are the Load cranks.

In FIG. 10, the cylinders A, B, C and D are shown in a position for explanation purposes. Actually, in a three dimensional drawing are perpendicular to the horizontal plane.

The connecting rods 19, 20 and 21 are an extension of the rods shown in FIG. 3 to accommodate the connection of the third crankshaft.

The Main crank 27 has at one end a gear 23 to be driven by the starter motor 22. The other end accommodates a flywheel 18. The drawing, for explanation, indicates a rotation direction 16. The directional rotation of all shafts is shown as 16, 12 and 15.

Load Crank 28 has a gear 13 attached. Load Crank 26 has gear 17 attached. Gear 14 is attached to transmission 10 and is engaged with both gears 13 and 17. The size of the gears is determined by design for best performance. Gear 14 has a rotational direction 11.

Because of the direction of gears 13 and 17, gear 14 is subjected to push/pull forces thus increasing its torque power.

Flywheel 18 may not be employed, if necessary, to provide for closer spacing to the end of the Cranks. Flywheels 24 and 25 may or may not be used depending of the design.

Referring to FIG. 10A, side view of the axis of the crankshafts, crankpins and connecting rods is shown. One cylinder A is shown for explanation purposes. Axis 51 belongs to the Main crank and 50 and 52 belong to the Load Cranks. Crankpins 59, 60 and 61 are pointing in the same direction. Crankpins 53, 54 and 55 are in their same direction and 180 degrees opposite to corresponding 59, 60 and 61. When piston rod 58 is in the downward motion, it causes rotational direction 62. This action causes connecting rods 63 and 64 to move in the direction 56 and 57. This arrangement creates a push/pull action to be applied to the Load Cranks 50 and 52.

Referring to FIG. 10B, a view of the gears 73, 74 and 75 referenced in FIG. 10 as 17, 14 and 13 respectively is shown. Core, 71 of the transmission shaft, and 70 and 72 of the Load Cranks is shown. The rotation 76 and 78 of the Load Cranks causes rotation 77 to the transmission gear. The gear 74 has a force applied to both ends of its diameter, thus creating a high torque to be applied to the transmission shaft 71.

Referring to FIG. 11, a view of a design of the crankpins is displayed. This to show that the Load crankpin offset 11*b* of the Load Crank 11*c* and its corresponding crankpin offset 11*a* that is part of the Master crank 11*e* are equal in offset length and longer than the offset 11*d* of the crankpin that connects to the cylinder connecting rod 11*g*. In addition in this design, the Master crankpin and the portion of the Load connecting crankpin are an integral design. This is to reduce space between Load crankpins and reduce the amount of required split bearings between crankpins. In addition this design has other counter torque benefits. The fact that the offset 11*a* is longer than the offset 11*d* allows the Load crank pin 11*b* to create more torque with a given force applied by the connecting rod 11*h*. The length 11*b* of the Load crankpin is determined at design time. The spare crankpins of the Master and Load Cranks are also decided at design time.

Referring to FIG. 12, the phase relationship between the crankpin of the Master Crank that connects to the cylinder connecting rod and the crankpin of the Master Crank that connects to the corresponding crankpin of the Load Crank is explained in more detail. Piston 12*h* of cylinder A is pushing connecting rod 12*s* in the direction 12*f*. This causes crankpin 12*e* of the Master Crank 12*a* to move to the direction 12*g* and Master Crank 12*a* to rotate in the direction 12*r*. Crankpins 12*c* and 12*e* of the Master Crank will have an angle relationship between them. Line 12*v* is in the same plane as the crankpin 12*e* and is shown for purpose of explanation. The angle (a) between line 12*v* and crankpin 12*c* will be designated as lagging and the angle (b) between line 12*v* and crankpin 12*q* as leading the crank pin 12*e*. The value of the angles will be decided at design time and could vary from zero degrees to a number plus or minus in relation to line 12*v*. Crankpin 12*d* of the Load Crank 12*b* will follow the orientation of the Master Crank pin 12*c* since they are connected with rod 12*k* for angle (a). Similarly, shown in dash lines, crank pin 12*p* will follow 12*q* since they are connected with rod 12*m* for angle (b). Blocks designated as 120 and bearings 121 are part of the engine block.

Other embodiments are not restricted to the particular details described herein. The specifications and drawings are to be regarded in an illustrative rather than a restrictive sense. It will be apparent that improvements and modifications may be made within the purview of the describe system without departing from the scope of the system defined in the appended claims.

The invention claimed is:

1. A system for converting the energy created by the ignition of fuel in one or more cylinders of an internal combustion engine to rotational power, wherein each cylinder comprises a piston, the system comprising:

a. one or more first connecting rods, each rotatingly affixed at a first end to the corresponding piston;

b. a master crank to which each such first connecting rod is rotatingly attached at a second end;

c. a load crank;

d. one or more second connecting rods, the number corresponding to the number of first connecting rods, each second connecting rod rotatingly affixed at one end to the master crank, and at the other end to the load crank;

e. one or two master flywheels, each affixed to one of the ends of the master crank;

f. one or two load flywheels, each affixed to one of the ends of the load crank; and g. a second load crank rotatingly affixed to each second connecting rod.

2. The system of claim 1, further comprising:

a. one or two master flywheels, each affixed to one of the ends of the master crank;

b. one or two load flywheels, each affixed to one of the ends of the load crank; and c. one or two second load flywheels, each affixed to one of the ends of the second load crank.

3. The systems of claim 2 or 1, wherein each second connecting rod is of the same length as the first connecting rod.

4. The systems of claim 2 or 1, wherein each second connecting rod is of a different length from that of the first connecting rod.

5. The system of claim 1, wherein each second connecting rod is of the same length as the first connecting rod.

* * * * *